United States Patent [19]

Cavanagh

[11] 4,277,329

[45] Jul. 7, 1981

[54] INDUCTION BELT SEPARATION

[75] Inventor: Patrick E. Cavanagh, Toronto, Canada

[73] Assignee: Maghemite Inc., Mississauga, Canada

[21] Appl. No.: 65,460

[22] Filed: Aug. 10, 1979

[30] Foreign Application Priority Data

Oct. 3, 1978 [GB] United Kingdom ..... 39108/78

[51] Int. Cl.[3] ..... B03C 1/22

[52] U.S. Cl. ..... 209/212; 209/223 R; 209/231

[58] Field of Search ..... 209/212, 227, 214, 223 R, 209/222, 223, 231, 213, 225, 226

[56] References Cited

U.S. PATENT DOCUMENTS

| | | | |
|---|---|---|---|
| 402,904 | 5/1889 | Conkling | 209/214 X |
| 1,564,731 | 12/1925 | Weatherby | 209/227 X |
| 1,657,405 | 1/1928 | MacLaren | 209/227 X |
| 1,729,589 | 9/1929 | Mordey | 209/223 R X |
| 3,824,516 | 7/1974 | Benowitz | 209/212 X |
| 4,003,830 | 1/1977 | Scholemann | 209/212 X |
| 4,127,477 | 11/1978 | Schloemann | 209/212 X |
| 4,137,156 | 1/1979 | Morey | 209/212 |
| 4,214,984 | 7/1980 | MacElvain | 209/214 |

*Primary Examiner*—Robert Halper
*Attorney, Agent, or Firm*—Sim & McBurney

[57] ABSTRACT

Electrically-conducting particles may be separated from mixtures thereof containing non-conducting particles by conveying the mixture through a magnetic field oriented angularly with respect to the part of conveyance. The magnetic field induces magnetic poles in the conducting particles, causing them to deflect from the path of movement of the mixture as they attempt to move in the angular orientation of the magnetic field. The non-conducting particles are unaffected, so that a separation may be achieved. The invention is applicable to a wide variety of materials, such as ores or tailings which contain desired electrically-conducting particles, such as, iron oxide, and unwanted gangue constituents.

10 Claims, 2 Drawing Figures

FIG.1.
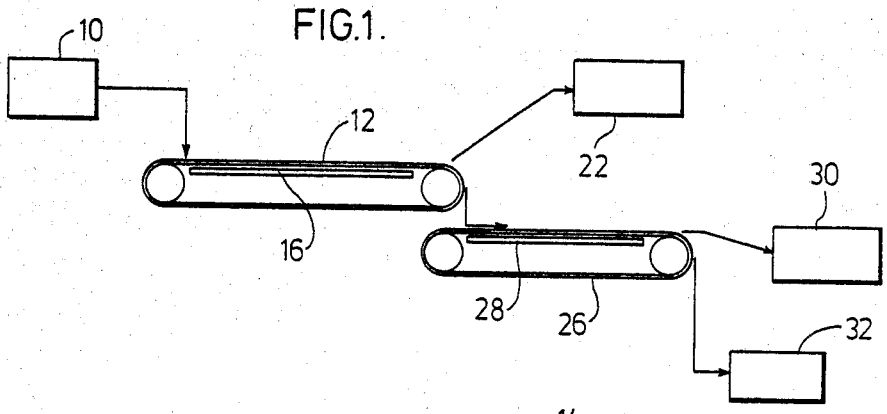
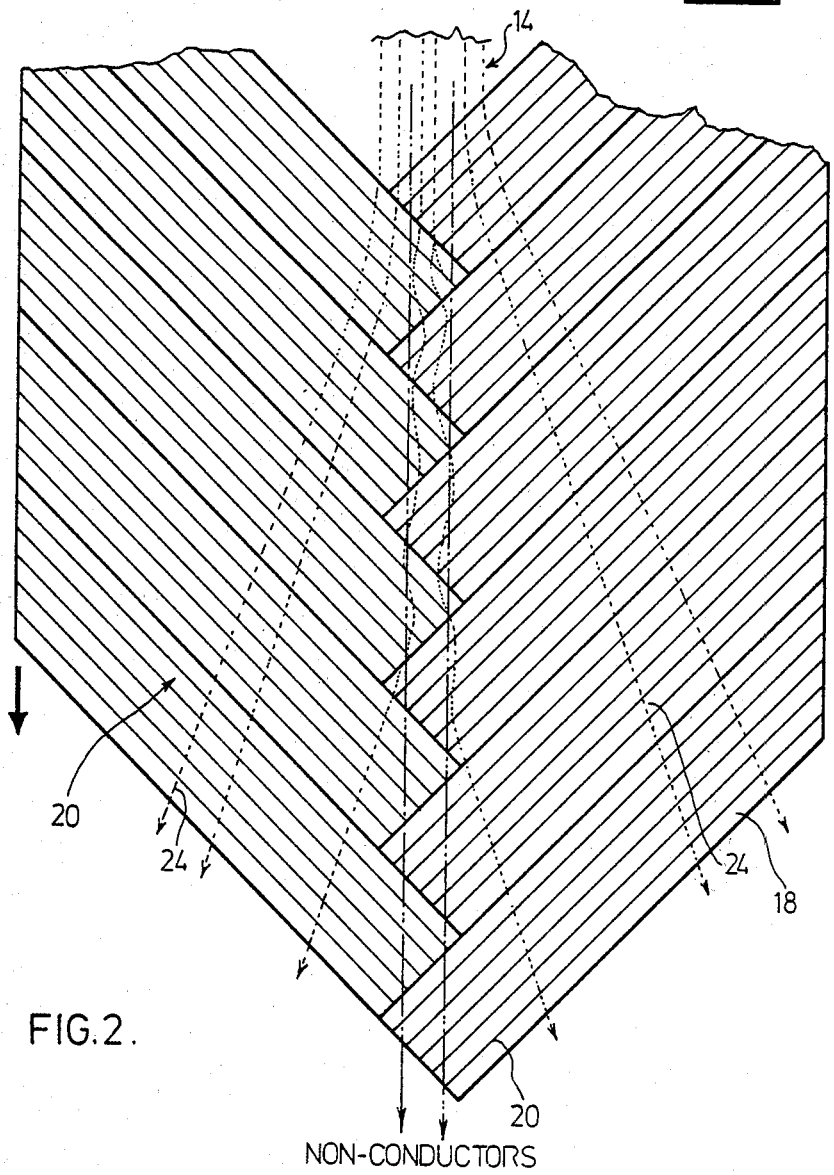
FIG.2.

INDUCTION BELT SEPARATION

FIELD OF INVENTION

The present invention is directed to the separation of electrically-conducting particles from non-conducting particles.

BACKGROUND TO THE INVENTION

Many naturally-occurring materials are electrically conducting and exist in ore bodies in admixture with various gangue constituents, which usually are non-conducting. Tailings streams from ore processing also usually contain similar mixtures.

Many attempts have been made to separate minerals on the basis of differences in properties and, in particular, techniques for the separation of magnetic and non-magnetic material are legion. Many of these prior procedures require complex equipment and are able to achieve only limited separation.

SUMMARY OF INVENTION

The present invention provides a method for separating electrically-conducting particles from mixtures thereof with non-electrically-conducting particles by a relatively simple yet effective technique. In this invention, such mixtures are conveyed through a magnetic field oriented angularly with respect to the path of conveyance to cause the electrically-conducting particles to assume a rolling motion and to deflect out of the conveyance path. In this way, the electrically-conducting particles separate from the non-conducting particles and may be separately collected.

BRIEF DESCRIPTION OF DRAWINGS

In FIG. 1 is an elevational view of part of a plant for processing iron-containing tailings streams and iron ores for the production of high purity iron oxide; and FIG. 2 is a plan view of one of the conveyor belts used in the plant of FIG. 1.

GENERAL DESCRIPTION OF INVENTION

The invention is applicable to the separation of any electrically-conductive material, including magnetic material, from non-conductive material. Representative examples of electrically-conductive materials which can be processed by the procedure of this invention include iron oxides, such as, specular hematite, other metal oxides, such as, titania, basic metal sulphides, such as, copper and nickel sulphide, coal and metals, such as, aluminum, copper, lead and zinc.

The mixture of conductive and non-conductive materials is required to be in particulate form for processing according to the procedure of this invention since rolling motion is induced in the electrically-conducting particles in this invention. The particle sizes may vary widely and the choice is dependent on a number of factors, discussed in more detail below. Generally, the particle size is about −8 to about +325 mesh.

The invention is based on the well-known principle that magnetic poles are induced in electrical conductors as they move through a magnetic field. In this invention, the mixture of conducting and non-conducting particles is conveyed in a rectilinear path through a magnetic field which is oriented transversely to the rectilinear path. This motion of the particles through the magnetic field causes the electrically-conducting particles to behave as if they were individual magnets while the non-conducting particles are unaffected.

The magnetic field, consisting of a multiple number of closely spaced alternate north and south poles is angularly oriented with respect to the path of movement of the particles. As, say, a south pole is induced in a conducting particle as it moves over a north pole in the field, the north pole on top of the particle will cause the same to be attracted towards the next south pole in the field, thereby causing the particle to roll one-half revolution. This rotation in the magnetic field causes the electrically-conducting particles to move towards the orientation of the magnetic field and hence out of the rectilinear path.

The degree of deflection of the electrically-conducting particles from the rectilinear path depends on a number of factors. Since motion of one-half revolution of the particle represents motion of one-half its circumference or 1.57 times its diameter of the particle, then optimum induced rotation is attained when the particle diameter is chosen as the magnetic pole spacing in the field divided by 1.57.

If the particle diameter is much greater than 0.637 times the magnetic pole spacing, the rotating force on the particle is greatly decreased and becomes non-existent for large particles. For particle diameters smaller than 0.637 times the magnetic pole spacing, the distance travelled is proportional to the diameter per pole, so that lesser sized particles travel less of a distance than greater sized particles, and hence are deflected less from the rectilinear path up to the limiting dimension of diameters of 0.637 times the magnetic pole spacing. In this way, a classification of particle sizes of the electrically-conducting particles can be attained in addition to separation of the conducting particles from non-conducting particles. The particle size spectrum of the mixture to be processed, therefore, depends to a considerable extent on the pole spacing in the magnetic field, which may vary from about 1/32 to about 1 inch.

The angle subtended by the magnetic field to the rectilinear motion path also affects the degree of deflection of the electrically-conducting particles, and generally varies from about 25 to about 50 degrees to the rectilinear path, preferably about 35 degrees.

The speed of movement of the particle mixture through the magnetic field and length of the magnetic field are other factors which affect the degree of deflection. At higher speeds, lesser deflection occurs than at lower speeds, and usually the speed is determined by a combination of throughput and deflection. Usually the speed of movement is about 40 to about 250 ft/min, for an array of magnets of about 10 to about 40 feet in length.

The mixture to be treated usually is fed to the rectilinear path as a relatively narrow and thin band of particles, preferably of uniparticular thickness and of width of about 5 to about 10 percent of the width of the magnetic field. The feed rate of the mixture to the belt depends on the speed of movement of the belt and usually is about 100 to about 200 lbs/hr.

The magnetic field strength can also affect the degree of deflection of the conducting particles and usually varies between about 100 and about 800 gauss.

The ability to attain efficient separation of conducting from non-conducting particles, therefore, depends on a number of factors which are readily determined for a given system and feed material. The factors are balanced to attain deflection of substantially all of electrically-conducting particles present in the initial mixture from the path of the mixture to the extent sufficient to enable the electrically-conducting particles to be collected as a product stream separately from the non-conducting particles.

DESCRIPTION OF PREFERRED EMBODIMENT

Referring now to the drawings, there is illustrated therein one separator line 10 of an ore or tailings processing plant for the recovery of high purity iron oxide from an iron ore concentrate or from iron rich tailings. In the plant a plurality of identical separator lines are used corresponding to the throughput requirement.

A source of material to be separated, for example, finely-divided iron ore, is fed from a storage area 10 onto the top surface of an endless belt conveyor 12 which conveys the material, which initially assumes the form of a relatively narrow thin bed 14 located on the centre line of the conveyor 12, from one end to the other.

Beneath the conveyor surface is a bed of magnets 16 producing a magnetic field through which the conveyed particles pass. The magnet bed 16 comprises a plurality of flat magnetic strips 18 arranged in planar alignment and in inclined orientation with respect to the centre line of the conveyor and nested at the centre line to form a herringbone-like assembly, as may be seen in FIG. 2.

Each of the magnetic strips 18 has a plurality of high strength magnets 20 of alternate north and south poles, so that the particles conveyed on the surface of the belt 12 are exposed to the field provided by the magnets.

The non-conducting particles are unaffected by the magnet field and remain in the relatively narrow bed 14 throughout the length of the conveyor 12 and are collected in a tailings bin 22.

Electrically-conducting particles have rolling motion imparted thereto by reason of movement thereof through the magnetic field, as discussed in more detail above, and are deflected from the path of the bed 14 and form streams 24 of increasing particle size from the feed bed towards the belt edges.

The conducting particles may be collected and reprocessed on a second conveyor belt 26 having an associated magnetic field bed 28 of the same form and type as bed 16. The second conveyor 28 enables a greater separation of higher conductive material from lower conductive material to be attained, the products being separately collected in bins 30 and 32.

In the illustrated embodiment, the magnetic strips 20 are formed into a herringbone structure and the material to be processed is fed centrally of the belts. An alternative arrangement is for the magnetic strips 20 to extend across the whole width of the bed and the material to be processed then is fed to the one side from which the strips angularly extend. Another alternative arrangement is to feed the material to be processed in two beds at the outer edges of the belt, the conducting particles being deflected towards the centre to form a product stream thereat while the non-conducting particles remain at the outer edges.

The magnetic beds 16 and 26 are illustrated as being located below the conveyor belts 16 and 28. They may alternatively or in addition be located above the conveyor belts if desired to impart the magnetic field to the feed bed 14.

EXAMPLES

Example 1

A series of rubber strips one inch wide and ⅛ inch thick containing magnetic poles about ⅛ inch apart were laid at an angle of 35 degrees beneath a 20 inch wide thin horizontal plastic sheet of length 20 feet to provide a magnetic field of 200 gauss at the upper surface of the plastic sheet and mounted for motion in the speed range of 0 to 400 ft/min.

The belt was fed with a 1½ inch wide band of Fire Lake Spiral concentrate (100%-35 mesh, 10%-100 mesh, 65.8% Fe, 5.4% $SiO_2$. As the particles travelled along the belt, those that are electrically-conducting rolled out of the rectilinear path and rolled across the belt at an angle of 35 degrees when the belt moved slowly, but at faster speeds, the vector of forward motion along the belt decreased the cross travel in proportion to the belt speed.

Four bins, each 4 inches wide were used to catch the material off the end of the belt. Bin no. 1 received the material that had not moved across the belt from the loading point and was divided into two sections (Bins nos. 1 and 2) since at belt speeds over 150 ft/min, the coarse ore particles which were too large to travel on the pole spacing were thrown further than the lighter and smaller gangue particles.

The smallest conductive particles were collected in Bin no. 3 adjacent to Bins nos. 1 and 2, since they travelled the shortest distance. Some gangue particles also occurred in this bin, resulting from having been pushed across the belt by the flow of rolling ore particles.

In Bins nos. 4 and 5 progressively larger particles were collected and less and less erratic gangue particles occurred. The best and purest concentrate was in Bin no. 5, while Bins nos. 4 and 3 usually contained concentrate that does not need repassing over the equipment.

The distribution of material in the 5 bins for different belt speeds and feed rates is set forth in the following Table I:

TABLE I

INDUCTION SEPARATOR
20" × 20' SINGLE TRACK-PERMANENT MAGNET BELT
FEED-FIRE LAKE SPIRAL CONCENTRATE

| Belt Speed ft/min | Feed Rate lb/hr | Product Weights - Percent of Feed | | | | | |
|---|---|---|---|---|---|---|---|
| | | Concentrates | | | Total | Mids | Tails |
| | | Bin 5 | Bin 4 | Bin 3 | Concs. | Bin 2 | Bin 1 |
| 40 | 60 | 2.47 | 6.66 | 6.72 | 15.85 | 84.15 | — |
| 40 | 75 | 4.58 | 7.28 | 6.37 | 18.32 | 81.68 | — |
| 40 | 86 | 6.38 | 5.95 | 5.29 | 17.54 | 82.46 | — |
| 40 | 100 | 6.39 | 5.95 | 5.56 | 18.17 | 81.83 | — |
| 100 | 60 | 0.60 | 6.64 | 26.23 | 33.47 | 66.53 | — |
| 100 | 75 | 1.37 | 8.60 | 24.32 | 34.28 | 65.72 | — |
| 100 | 86 | 1.46 | 8.42 | 23.50 | 33.42 | 66.58 | — |
| 100 | 100 | 3.16 | 11.57 | 25.25 | 39.98 | 59.97 | — |
| 205 | 60 | 1.03 | 6.18 | 26.79 | 34.00 | 58.74 | 7.21 |
| 205 | 75 | 0.37 | 5.09 | 29.32 | 34.79 | 57.76 | 7.45 |
| 205 | 86 | 0.42 | 5.84 | 27.29 | 33.55 | 59.06 | 7.39 |
| 205 | 100 | 0.35 | 5.69 | 28.02 | 34.05 | 59.59 | 6.35 |
| 250 | 60 | 0.76 | 3.18 | 23.85 | 37.79 | 65.20 | 6.36 |
| 250 | 75 | 0.04 | 1.54 | 24.10 | 25.68 | 70.35 | 3.97 |
| 250 | 86 | 0.20 | 4.25 | 28.70 | 33.16 | 66.84 | 5.07 |
| 250 | 100 | 0.22 | 3.70 | 23.74 | 27.67 | 63.96 | 8.38 |

It will be seen from the above results that belt speed was the most significant factor in determining performance. When the belt speed was increased to over 180 ft/min, the discharge into Bin no. 1 was divided into middlings and tailings.

As may be seen from the amounts of concentrate in Bin no. 5, speeds over 200 ft/min decrease the amount of the coarser higher grade concentrate in this bin and in Bin no. 4.

Similar results were obtained when the following concentrates were processed using the apparatus:

(a) Ungava iron ore from the Atlantic permit no. 638;
(b) Cu-Ni ore;
(c) Ilmenite ore from Lac Allard, P.Q.; and
(d) Martite-containing iron ore from Benson Mines, Star Lake, N.Y.

Example 2

An operating model of commercial-sized equipment was constructed with a primary belt 20 in. wide and 20 ft. long and a secondary belt 20 in. wide and 10 ft. long. A tailings stream from a wet high intensity magnetic separation procedure at Sidbec-Normines containing over 60% iron was dried and processed at a belt speed of 140 ft/min.

The coarser and heavier material was thrown over a divider to give a middlings stream which was mostly +40 mesh and contained about 67% iron. This material is suitable for recycling to a pellet plant.

The results are outlined in the following flow diagram:

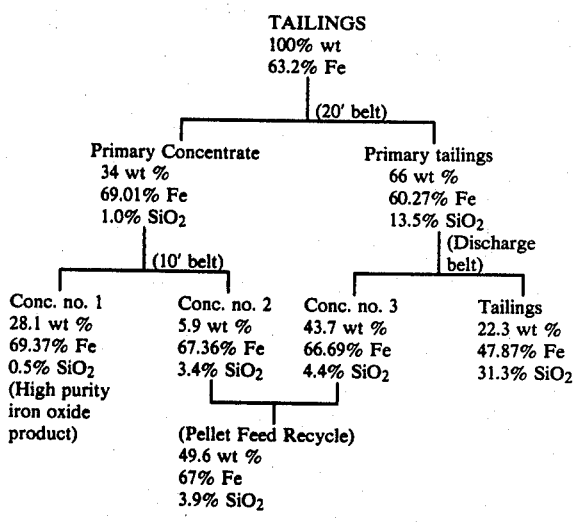

The results reproduced above show that a high purity iron oxide product and a pellet feed recycle stream can be readily obtained from the tailings stream.

SUMMARY OF DISCLOSURE

In summary of this disclosure, the present invention provides a method of separating electrically-conducting particles from non-electrically-conducting particles in simple and efficient manner. Modifications are possible within the scope of this invention.

What I claim is:

1. A method of separating electrically-conducting mineral particles from non-electrically-conducting mineral particles, said particles having a particle size of about −8 to about +325 mesh, which comprises:

conveying a dry mixture of said conducting and non-conducting particles along a substantially rectilinear path, said mixture being of uniparticular thickness, subjecting said mixture to alternate north and south magnetic poles spaced apart about 1/32 to about 1 inch and arranged at an acute angle to said rectilinear path in the conveying direction to exert a magnetic field of strength of about 100 to about 800 gauss on said mixture and to cause said electrically-conducting particles to rotate towards the next successive magnetic pole and assume a path of movement out of said rectilinear path and towards said angle while said non-conducting particles remain undeflected in said rectilinear path, said rectilinear path being about 5 to about 10 percent of the width of the magnetic field, said deflected particles having a diameter which is less than or equal to about 0.637 times the magnetic pole spacing and said deflected particles of greater particle size being deflected from said rectilinear path to a greater extent than said deflected particles of smaller particle size, and separately collecting at least one stream of deflected particles and at least one stream of undeflected particles.

2. The method of claim 1 wherein said magnetic field is angled about 25 to about 50 degrees to said rectilinear path.

3. The method of claim 2 wherein said angle is about 35 degrees.

4. The method of claim 1 wherein said mixture is conveyed through the field at a speed of about 40 to about 250 ft/min adjacent an array of magnets of about 10 to about 40 feet in length.

5. The method of claim 4, wherein said mixture is fed to the conveying surface at a rate of about 100 to about 200 lbs/hr.

6. The method of claim 1 wherein the magnetic field is angled about 25 to about 50 degrees to said rectilinear path, the mixture is conveyed through the field at a speed of about 40 to about 250 ft/min adjacent an array of magnets of about 10 to about 40 feet in length, and the mixture is fed to the conveying surface at a rate of about 100 to about 200 lbs/hr.

7. A separator apparatus for separating electrically-conducting particles from non-electrically-conducting particles, which comprises:

conveyor means for conveying a mixture of said particles in a horizontal rectilinear path.

feed means for feeding said mixture of said upstream end of said conveyor means, collection means for collecting individual separate product streams from said belt, and magnet array means located in juxtaposed position to said conveyor means to exert magnetic forces on said particles on said conveyor means, said magnet array means including a plurality of alternate north and south magnetic poles arranged in a herringbone arrangement when viewed in plan, the herringbone arrangement including a plurality of first individual groups of said alternate magnetic poles having a leading edge and side edges and a plurality of second individual groups of said alternate magnetic poles having a leading edge and side edges, the first individual groups extending into engagement between the front edge thereof and one side edge of the second individual groups with the second individual groups extending into engagement between the front edge thereof into one side edge of the next adjacent first individual groups, the plurality of first individual groups extending in side edge abutting relationship at a first angle with respect to the longitudinal axis of the conveyor with the plurality of second individual groups extending in side edge abutting relationship at a second angle to the longitudinal axis of the conveyor on the opposite side of said longitudinal axis from said first angle.

8. The apparatus of claim 7, wherein said magnetic poles are arranged at an angle of about 25 to about 50 to said axis.

9. The apparatus of claim 8, wherein said angle is about 35 degrees.

10. The apparatus of claim 7, 8 or 9 wherein said conveyor means has a length of about 10 to about 40 feet.

* * * * *